US005375102A

United States Patent [19]

Schiavolini

[11] Patent Number: 5,375,102

[45] Date of Patent: Dec. 20, 1994

[54] CLOCK HAVING INTERCHANGEABLE DECORATIVE MEMBER

[76] Inventor: Mariano Schiavolini, Via Privata Firenze, 6, 18039 Ventimiglia (IM), Italy

[21] Appl. No.: 856,464

[22] Filed: Mar. 24, 1992

Related U.S. Application Data

[63] Continuation-in-part of Ser. No. 466,227, Jan. 17, 1990.

[30] Foreign Application Priority Data

Mar. 27, 1991 [IT] Italy ..... IM91 U 000003[U]

[51] Int. Cl.[5] ..... F04B 45/00; G04B 19/04

[52] U.S. Cl. ..... 368/10; 368/80; 368/223

[58] Field of Search ..... 368/20, 80, 223–242, 368/276–286

[56] References Cited

U.S. PATENT DOCUMENTS 4,332,020 5/1982 Leopold .

FOREIGN PATENT DOCUMENTS 199298 10/1986 European Pat. Off. .
506007 9/1992 European Pat. Off. .
2538803 3/1977 Germany .
131706 2/1929 Switzerland .
332892 9/1958 Switzerland .
196804 5/1923 United Kingdom .

*Primary Examiner*—Bernard Roskoski
*Attorney, Agent, or Firm*—Ostrolenk, Faber, Gerb & Soffen

[57] ABSTRACT

Alarm clocks, wall clocks, watches to be inserted on knapsacks and similar articles are provided with an interchangeable decorative member, possibly colored, which may be mounted directly on top of a fixed glass member on the clock or watch so that it is possible to repeatedly change the appearance of the alarm clock, the wall clock or the knapsack. There is provided at least one support for the decorative member which is placed on the opening of a frame of the clock or watch and which is adapted to the shape of the opening so that by the insertion of magnets or by means of pressure, the interchangeable decorative member is fixed. The decorative member may be opaque or transparent and may be made of glass, plastic, paper, a mirror or a ceramic material. The decorative member may also be mounted on a clock or watch without a support.

28 Claims, 10 Drawing Sheets

CLOCK HAVING INTERCHANGEABLE DECORATIVE MEMBER

This application is a continuation-in-part of Ser. No. 466,227 filed on Jan. 17, 1990.

BACKGROUND OF THE INVENTION

Field of the Invention

The present invention relates to a clock such as an alarm clock, a wall clock, or a watch to be mounted on a knapsack and similar articles. More specifically, the invention relates to interchangeable decorative members which may be mounted on the alarm clock, wall clock or watch to be inserted in the knapsack or similar articles.

SUMMARY OF THE PRESENT INVENTION

The decorative members of the present invention may be holograms and may be made of paper, metal, plastic, or a mirror and could even be made of ceramic or stone. The decorative members may have a variety of designs and may be colored. The decorative members are placed over the hands and on top of the fixed glass of the clock or watch.

The dial of the clock or watch, the interchangeable decorative member, the support for the decorative member and the frame of the clock may have a variety of shapes such as square, round, rectangular, oval, or any other shape and may also have a variety of thicknesses. Also, the support for the decorative member may be made of a variety of materials such as plastic, metal, and may have a variety of colors. The decorative member may be opaque or transparent, but even when the decorative member is opaque, the hands of the clock or watch located below the decorative member are visible so that a person can read the time and also enjoy the decorative member. For the purpose of reading the time, it is also possible to use systems different from conventional hands.

In order to read the time, according to one embodiment of the invention, the interchangeable decorative member is transparent so that it is possible to see the hands of the clock and read the time.

According to another embodiment of the invention, the interchangeable decorative member is provided with non-transparent symbols which are used like numbers in a conventional clock to indicate the time. In this case, the hands which are under the decorative member will indicate the time at the particular moment in which they are moved under the symbols.

The hands according to the present invention are longer and wider than the conventional hands but have the same length as each other. That is, the hand which indicates the hour, and the hand which indicates the minute and the hand which indicates the seconds, if provided, have the same length.

According to a preferred embodiment of the invention, the hands are fluorescent.

In the case of the alarm clock, there is also provided a fourth hand which has the same characteristic of the hands described hereinabove and which serves the purpose of programming an alarm to sound at a particular predetermined time.

According to a specific embodiment of the invention, the interchangeable decorative members are smaller with respect to the size of the fixed glass and are placed on the central part of the fixed glass so that the perimeter of the watch is transparent.

The interchangeable decorative member may be commercially available and may be already sold together with a transparent support or may be contained in the lateral part of the clock in a particular frame formed of a plastic material or glass.

The decorative member and the support may be connected by glue, by welding or soldering, or may be put together by pressure. The decorative member and the support are placed on top of the fixed glass.

The symbols mentioned hereinabove which are used to indicate the time are placed on the sides of the support or on the side of a transparent frame so that the hands which are located under the decorative members may be easily seen. The symbols may also be printed on the sides of the fixed glass and in this case the support or the frame are totally transparent.

According to one embodiment, the decorative member may be made of a mirror and located in a frame made of glass or transparent plastic material which has the symbols indicating the time located along its perimeter.

According to another embodiment of the invention, it is possible to use a decorative member which functions as a calendar and has inserted in its internal part a pin which contains two hands. Each of the two hands rotates independently with one hand indicating the day and the other hand indicating the months of the year which are printed on the side of the decorative member.

In the case of an alarm clock or a watch inserted in a knapsack and similar articles, the decorative member is placed within the outline of the opening of the frame and above the fixed glass and is held by a support which is applied on the border of the clock.

According to another embodiment, the decorative member is applied without any support. In this embodiment, the seat within which the decorative member is to be inserted has dimensions such that the decorative member is held in it and the user only has to apply slight pressure to the decorative member so that the decorative member is held in that space defined by the internal walls of the seat. In this case, the substitution of one decorative member with another may be easily carried out by inserting a point, for instance a penpoint on an upper side of the frame on which a small vertical slit is made. It is also possible to form one of the two sides of the upper part of the frame with a small cut-out to allow the user to change the decorative member simply by inserting his fingernail. It is also possible to provide a seat that is less deep with respect to the height of the decorative member so that the upper part of the decorative member protrudes slightly from the surface of the frame of the clock. In this manner, the user may apply pressure on the external borders to substitute a new decorative member.

The support for the interchangeable decorative member may be mounted in a variety of manners. One embodiment includes applying on the clocks magnets of weak magnetization so that they will not interfere with the operation of the clock. For instance, the type of magnet which is preferably used is composed of samarium and cobalt and is very small. These magnets are applied either in the interior of the opening of the frame or in the lower part of the support. This system facilitates the substitution of the interchangeable decorative member by eliminating every complication in actual use and permits the manufacturer to utilize clocks which already exist without modifying the structure of the frame because only one support adaptable to the dimensions and to the shape of the opening of the frame is required. This system also facilitates the use of watches which are on the market but which have not been sold yet so that they may be updated because it is possible to easily and inexpensively modify the appearance of the watches by adding the interchangeable decorative member.

In the particular case of the fixed dial of an alarm clock in the upper surface where the decorative member is placed, there is conventionally provided a small opening which permits the user to program the alarm to sound at a predetermined time. For this operation, an internal wheel is used. This wheel has time indicating symbols on its entire circumference such that the time indicating symbols are always visible from the slit of the dial.

In contrast, according to the present invention, the time indicating symbols or numerals are utilized at the particular time according to how the alarm clock has been programmed and are not visible when they are not necessary because they can interfere with the reading of the dial or the appearance of the interchangeable decorative member. For this reason, there is provided a wheel which has the numerals only in one part of its circumference and the part which has no numerals, is of the same color as the fixed dial, for instance white, or it may show the trademark of the article. In this manner, when the user does not need the alarm clock to sound at a particular time, the user may turn the wheel so that only the area of color, for instance white, or the area bearing the trademark is visible. In order to increase the visibility of the numerals, which is necessary for programming the alarm clock particularly during the night without removing the interchangeable decorative member, krizia is applied to the numerals to render them phosphorescent. The fixed internal dial which is placed under the hands is of only one color, preferably white so that the hands may be seen.

According to another embodiment, there is used a narrower support applied with pressure along the external perimeter of the opening of the frame of the clock.

According to another embodiment, there is formed a stepped structure on the external side of the frame which permits the support to be inserted with pressure along the perimeter. This operation may also be carried out on the front part of the clock in the case in which the opening of the frame has a few raised parts which permit the adaptation of the support to the opening so as to hold the interchangeable decorative member.

The support may also be inserted on the frame by means of a closure operating with a screw. According to this embodiment, along one side of the frame there are formed threads in which the support which having a helicoidal raised portion is screwed. The support may also use different systems such as a bayonet type, a system which utilizes a few small curved pins which are placed within the internal part of the support or along the border of the frame, or small teeth which are inserted in respective seats formed in a portion of the matching structure. The user will push and simultaneously slightly rotate the support up to the time when the pin or the tooth is blocked within the respective seat.

The support may also be located along the external border of the fixed glass which in this case will protrude and has a four-sided shape so that the support is blocked on its lateral side. According to this embodiment, the support is made of plastic and elastic material to permit a perfect adherence and to prevent the glass from being scratched. When the support is made of a rigid material, it is preferably inserted on the frame by pressure along the upper part by a snapping motion. On the other hand, when the support is made of a plastic and elastic material, it is slightly extended by the user along its external part after which it is fixed by adapting to the structure of the glass or along the side of the frame.

The elastic support may be provided along its side with small openings to permit substitution of one support for another. These openings may have a variety of shapes so as to give to the user a further variation in the shape of the final product.

The interchangeable decorative member may be made of a thin film which may be colored so that the decorative member can adhere to a transparent glass or the film may be applied directly on the fixed glass of the clock. This operation may be carried out without the use of the support but rather by known systems such as glue, adhesion materials, or creating a vacuum to hold the decorative member. In this manner, the film may be easily removed and substituted.

In the case of a clock which is flat, such as a wall clock, but adaptable also for a watch to be inserted in a knapsack or similar articles, there is provided the application of the interchangeable decorative member sold with an appropriate support. It is also possible to make a channel along the front of the frame or to provide along the sides of the frame a stepped structure along which the support is applied with magnets. The same fixed glass may form a stepped structure. The application may also be carried out with pressure.

The small channel along the front of the frame is used either for holding the support with pressure or for arranging the support with the magnets so that the support is better fixed along the front of the clock. In the case of a wall clock and a watch mounted on a knapsack or similar articles, differently from alarm clocks, it is preferable to utilize an interchangeable decorative member already mounted with its own support because in this case the user must only remove the support without placing the interchangeable decorative member within the opening of the frame above the fixed glass. For the substitution of the interchangeable decorative member on an alarm clock or a watch inserted in a knapsack or similar article, the user can use his finger to slide the decorative member such that the decorative member remains on top of the fixed glass.

According to another embodiment, the interchangeable decorative member may be substituted by applying one or more small fan shaped members along the internal part of the support. The fan shaped members will adhere at the time of use to the external side of the interchangeable decorative member, thus attracting the decorative member when the support is raised.

A plurality of interchangeable decorative members may be provided with a single support or each one of the decorative members may have its own support. The interchangeable decorative member may be inserted either in the internal lower part of the support or in the upper part.

According to another embodiment, the opening of the frame of the clock or watch has an attachment or support member which permits the user to insert a dial or interchangeable decorative member on the face of the watch without using the external support. The support is an opaque member inserted on the frame of the clock or watch and may serve as a support or for locking the decorative member. A transparent frame can be used as a support and can have variable dimensions which depend on the size of the interchangeable decorative member. This transparent frame is held simply by pressure applied by its external sides on the internal part of the frame. This frame has flat sides and is wider than the support mentioned hereinabove.

A transparent frame which allows the interchangeable decorative member to be placed in its interior may also be used.

Other features and advantages of the present invention will become apparent from the following description of the preferred embodiments with reference to the accompanying drawings.

DETAILED DESCRIPTION OF THE PREFERRED EMBODIMENTS

Figure 1A:
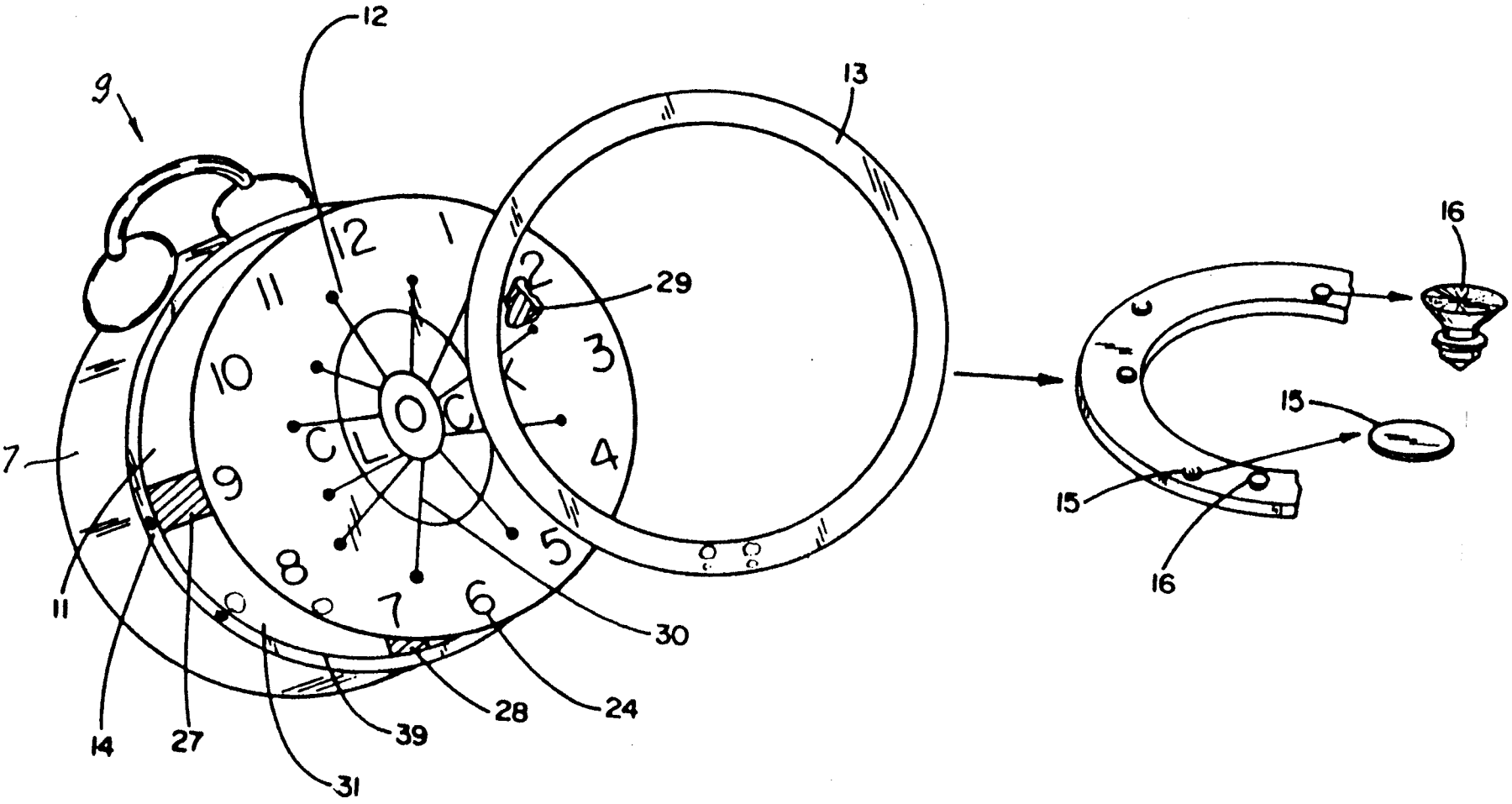
FIG. 1A illustrates a clock of the present invention having an interchangeable decorative member held in position by a support and magnets located on the support.
Figure 1B:
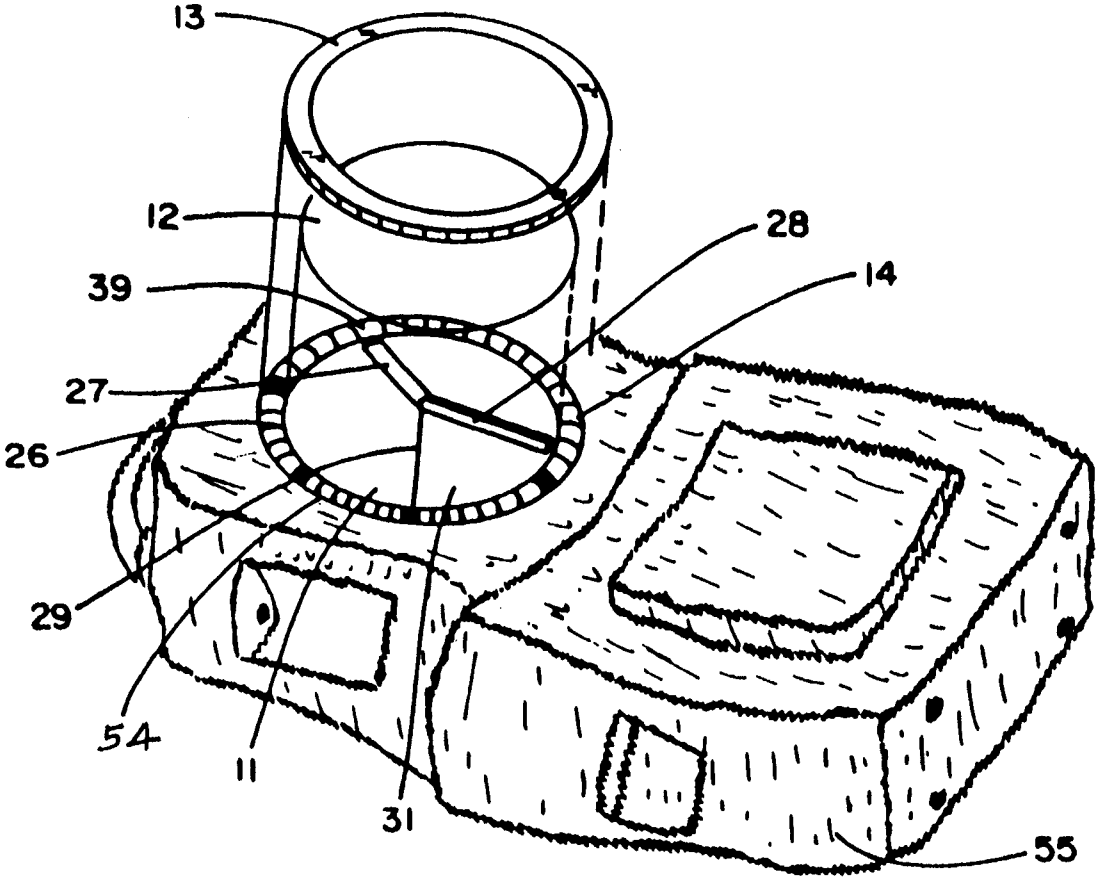
FIG. 1B illustrates a clock with an interchangeable decorative member wherein the clock is inserted in a knapsack.

Referring now to the drawings wherein like numerals indicate like elements, a clock 9 is shown in FIGS. 1A and 1B. This clock 9 may be an alarm clock, a clock to be mounted on a wall or a watch to be mounted in a knapsack or similar article as seen in FIG. 1B. Clock 9 includes an hour hand 27, a minute hand 28 and a second hand 29. Clock 9 also includes a dial 31 and a fixed glass member 11 covering dial 31 and hands 27–29.

In addition, clock 9 has a frame 7 having a plurality of openings 14 located therein. Frame 7 forms a seat 39 on which an interchangeable decorative member 12 can be removably located on clock 9.

As described below, interchangeable decorative member 12 can be mounted on a frame **33*a* or transparent support 33*b* which form a transparent assembly 24. Transparent assembly 24 of interchangeable decorative member 12, frame 33*a* or transparent support 33*b* are held in place on clock 9 by a support 13. Support 13 includes magnets 15 which cooperate with openings 14 of the clock frame to lock support 13 and decorative member 12 to clock 9. Support 13 also includes fan-shaped members 16 which adhere to the side of decorative member 12, frame 33*a* or transparent support 33*b***.

Hands 27, 28 and 29 have the same length,are longer and wider than conventional hands and are fluorescent so that it is possible to see them through the elements of transparent assembly 24 which includes numerals for indicating the time. Numeral 30 represents one possible decorative design.

Another embodiment of the present invention is shown in FIG. 1B in which a watch 26 is mounted in a knapsack 55. Knapsack 55 has an opening 54 in which watch 26 is mounted. Like clock 9 shown in FIG. 1A, watch 26 has a fixed glass member 11 and a seat 39 for accommodating a decorative member 12.

Watch 26 also has a support 13 to lock the entire assembly including decorative member 12, frame **33*a* or transparent support 33*b* in place. Support 13 is applied with pressure into the opening 14** of the frame.

Figure 2:
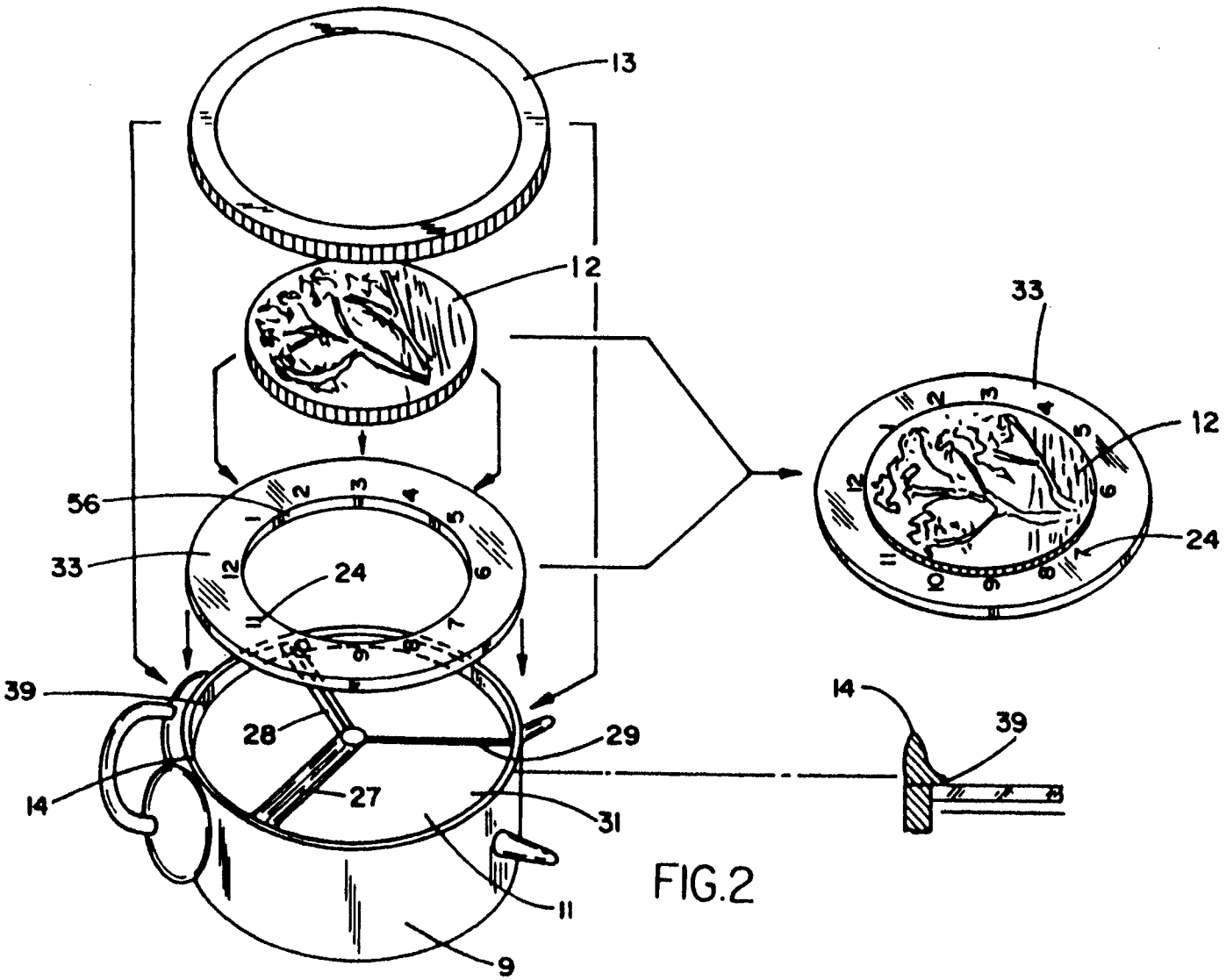
FIG. 2 shows a clock having an interchangeable decorative member inserted in a frame and held by a support frame.

Another embodiment of the present invention is shown in FIG. 2 in which an alarm clock 9 includes an opening 14 in the clock frame and a fixed glass member 11 which forms a seat 39. This seat 39 permits the insertion of frame **33*a* or a transparent support 33*b* not shown. Frame 33*a* in this embodiment has numerals 24 which designate the time and an internal part 56 which receives a decorative member 12. Alternatively, seat 39 may also be used to insert transparent support 33*b* which also has numerals 25 for designating the time. The entire assembly is locked by support 13 which is firmly held on top of opening 14. Alarm clock 9 includes a fixed dial 31 which has a light color and the hour, minute and second hands 27, 28 and 29**, respectively.

Figure 3:
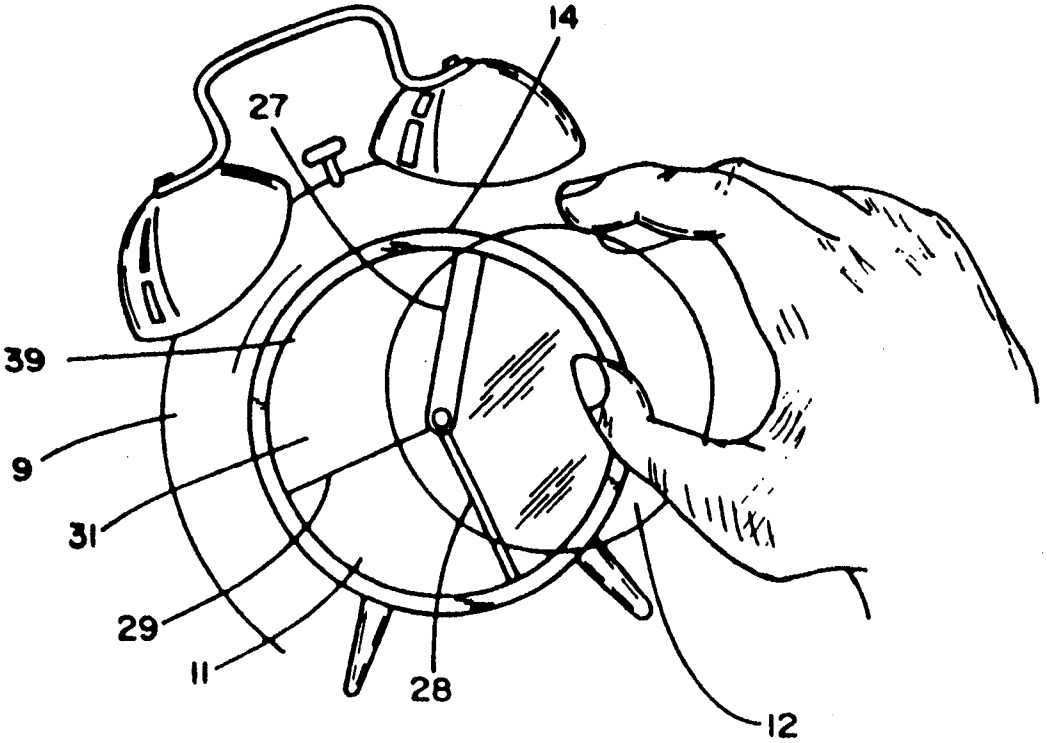
FIG. 3 shows an alarm clock having an interchangeable decorative member being inserted thereon.

FIG. 3 illustrates how a decorative member is mounted on the face of a clock 9. Seat 39 formed by glass member 11 permits the insertion of the decorative member 12 or transparent support **33*b* which supports decorative member 12. To install a decorative member 12, pressure is applied on decorative member 12 thus causing the decorative member to slide on the surface of the fixed glass 11** into a desired position.

Figure 4:
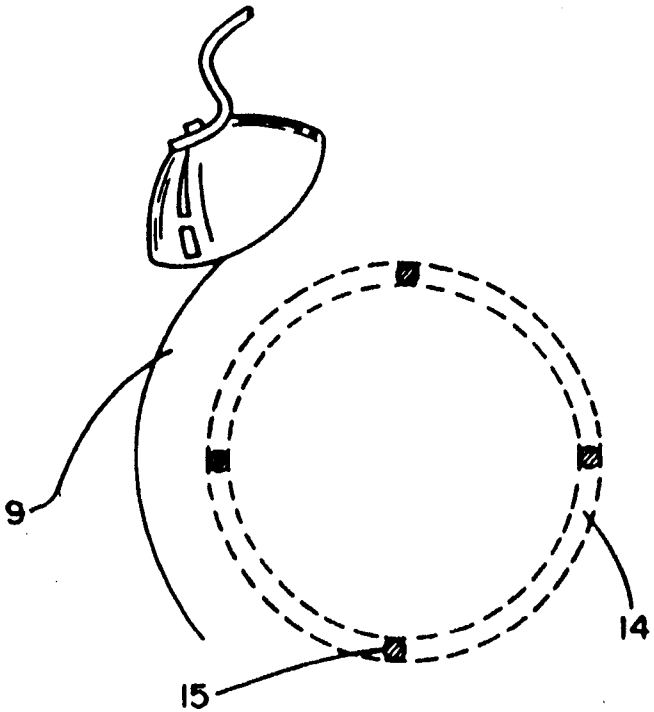
FIG. 4 illustrates a support for holding the interchangeable decorative member on a clock.

FIG. 4 illustrates the insertion of support 13 on a clock 9 or watch 26 such as that shown in FIGS. 1–3. Opening 14 has an internal part in which a plurality of magnets 15 are located. Magnets 15 attract and fix the support 13 on the clock or watch so that the decorative member 12 is held in place on the face of the clock or watch.

Figure 5:
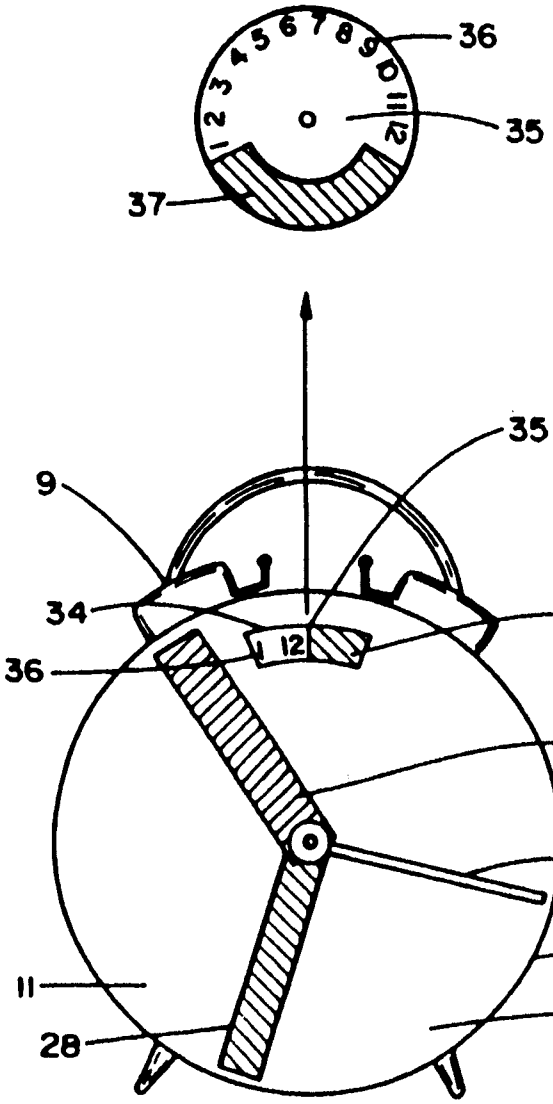
FIG. 5 shows an alarm clock having an improved alarm setting member.

FIG. 5 illustrates a new alarm setting member for using the alarm in an alarm clock 9. Alarm clock 9 has a fixed dial 31 of a light color. Dial 31 has an opening 34 in its upper part in the same location where ordinarily decorative member 12 is placed. In the interior of clock 9, an alarm setting wheel 35 is provided and has numerals 36 for designating the time formed only along one part of the circumference of wheel 35. The other part of wheel 35, designated by numeral 37, has no numbers and has the same color as the color of dial 31. Thus, when the alarm is net set, only the unnumbered part 37 of wheel 35 is visible and therefore the numerals 36 do not interfere with the appearance of decorative member 12.

Figure 6:
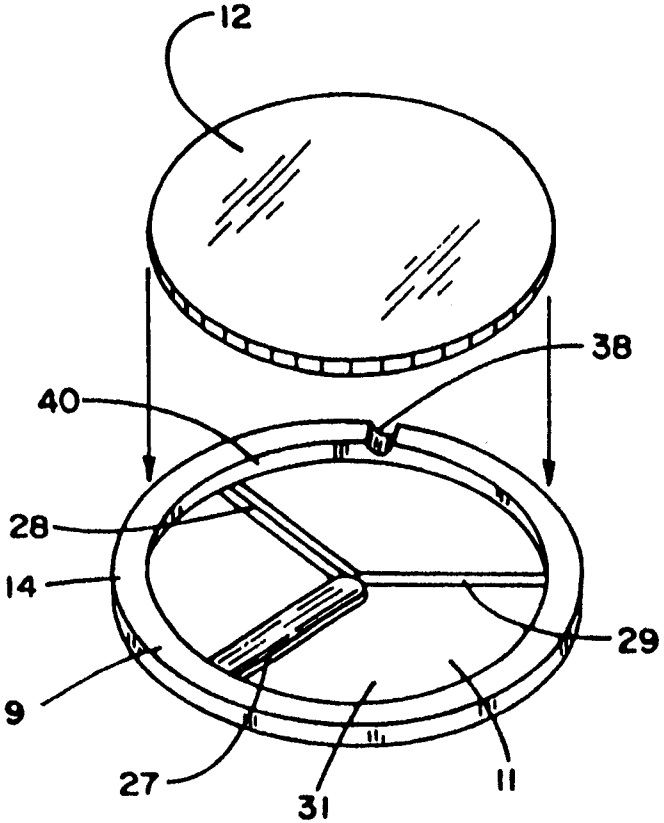
FIG. 6 shows a frame of a clock for holding an interchangeable decorative member.

FIG. 6 illustrates a part of the frame in clock 9. The internal part of the opening 14 and the fixed glass member 11 form a compartment 40 which serves to lock decorative member 12 in place on frame 7. Decorative member 12 can also be placed either on a frame 33*a* or on a transparent support 33*b*. Opening 14 has an indentation 38 which is used instead of support 13 to lock decorative member 12 in place.

Figure 7:
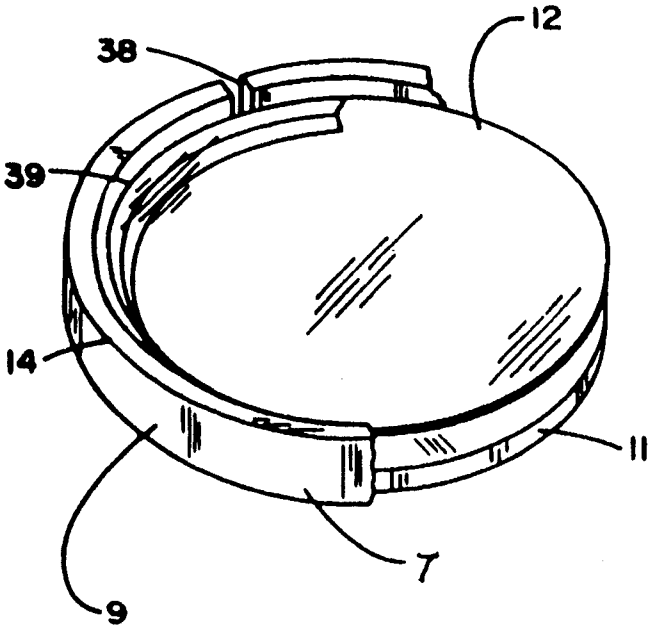
FIG. 7 illustrates an alternate embodiment of a frame of a clock for holding an interchangeable decorative member.

FIG. 7 illustrates a part of a frame for a clock 9 which includes opening 14 in the frame of clock 9 and a step which forms seat 39. Decorative member 12 is inserted with pressure into seat 39 and is located either on frame 33*a* or on transparent support 33*b*. The fixed glass member 11 is fixed on opening 14 by means of indentation 38 shown in FIG. 6.

Figure 8:
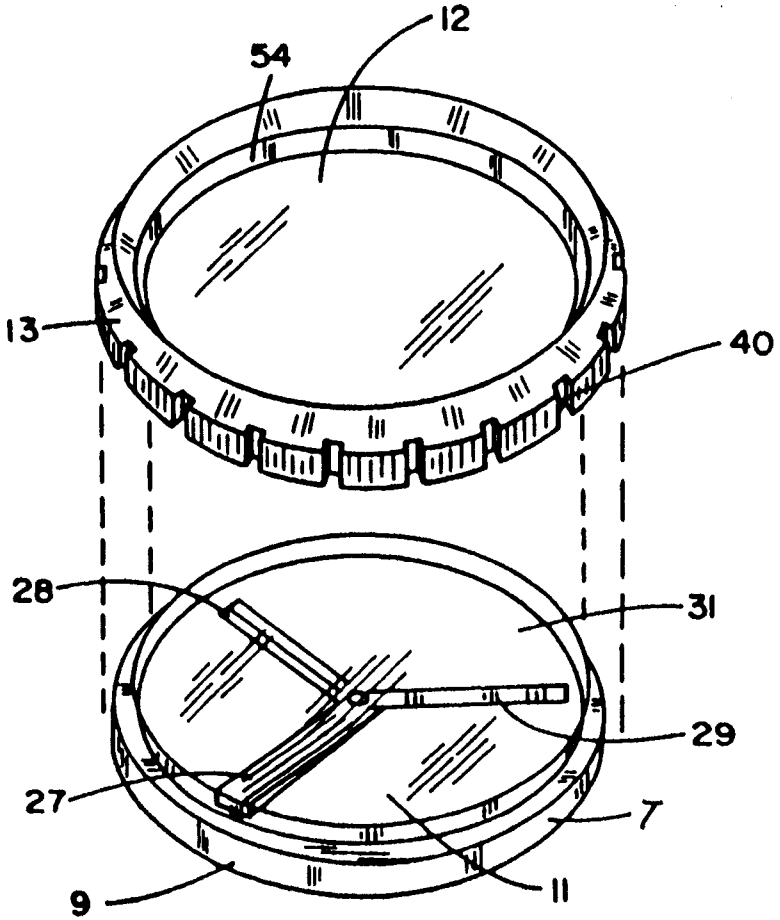
FIG. 8 shows a top part of the frame shown in FIG. 7.

FIG. 8 illustrates the upper part of frame 7 suitable for a clock 9 including a support 13 which holds the interchangeable decorative member 12 in a seat 54. Support 13 is made of elastic and plastic material and is provided along its outer border with openings 40 which increase the elasticity.

Figure 9:
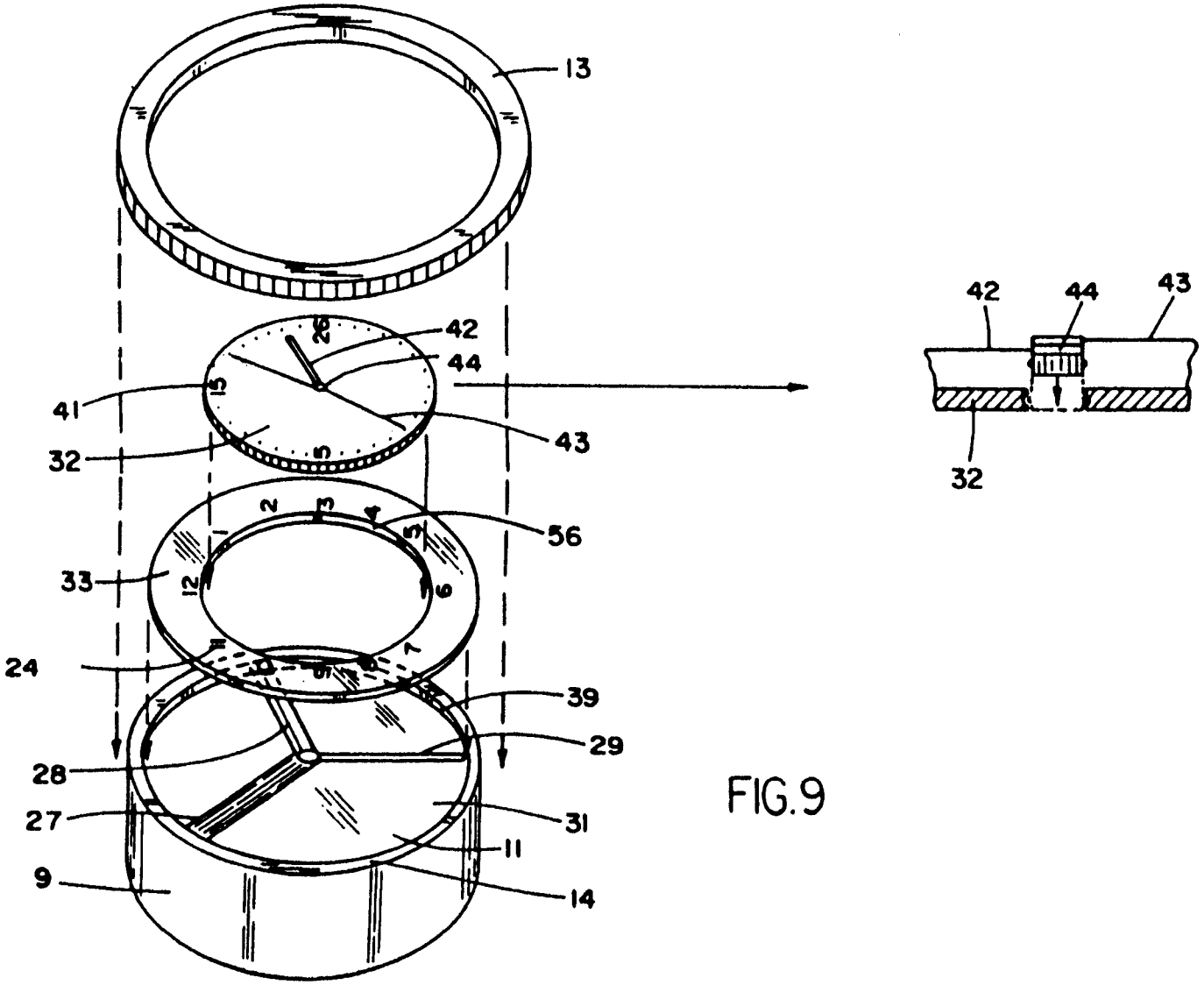
FIG. 9 illustrates a clock having a decorative member and hands for functioning as a calendar.
Figure 10:
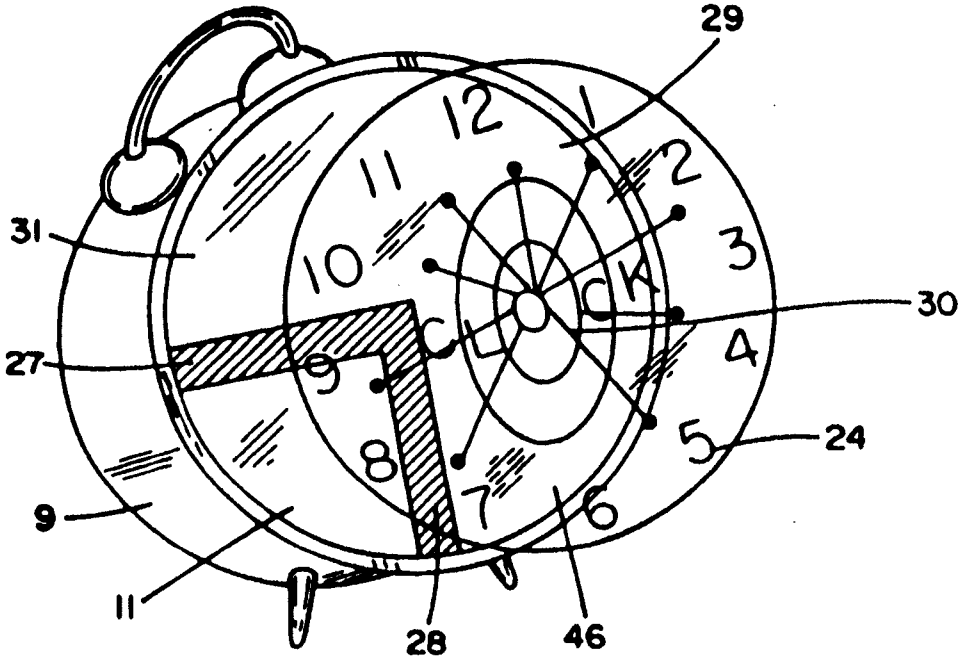
FIG. 10 shows an interchangeable decorative member in the form of a film which adheres to a glass face of a clock.

FIG. 9 illustrates a clock 9 to be inserted on a wall or knapsack. Clock 9 includes opening 14, fixed glass member 11 and seat 39 formed by opening 14 and fixed glass member 11. Seat 39 permits the insertion of frame 33 which has the numerals 24 for indicating time. Frame 33 also has an internal part 56 for receiving a decorative member 32. In this case, the decorative member 32 is provided with a calendar including hands 43 and 44 for indicating the days and a hand 42 for indicating the month. The hands rotate independently on a pin 44 which is inserted in the central internal part of decorative member 12. The entire assembly is locked by support 13 which is held in opening FIG. 10 illustrates an alarm clock 9 which includes a film 46 having numbers 24 for designating the time. Film 46 adheres to the surface of fixed glass 11. The time is read at the time when the hands 27, 28 and 29 pass under the numerals 24.

Figure 11:
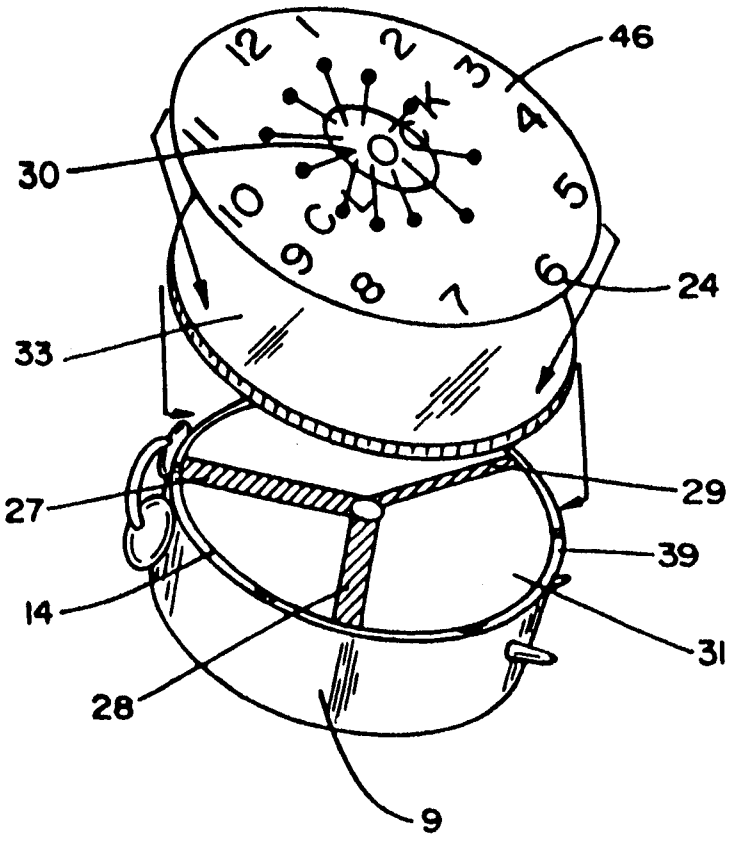
FIG. 11 shows an interchangeable decorative member mounted on a transparent support which is mounted on a clock.

FIG. 11 illustrates an alarm clock 9 which includes a decorative member 46 in the form of an interchangeable film which adheres on the upper part of transparent support 33*b*. This film 46 has numbers 24 and numeral 30 represents the ornamental design. The support 33*b* together with the film 46 is inserted in the seat 39 formed between the opening 14 of the frame and the fixed glass member 11 which is enclosed by support 13 (not shown).

Figure 12:
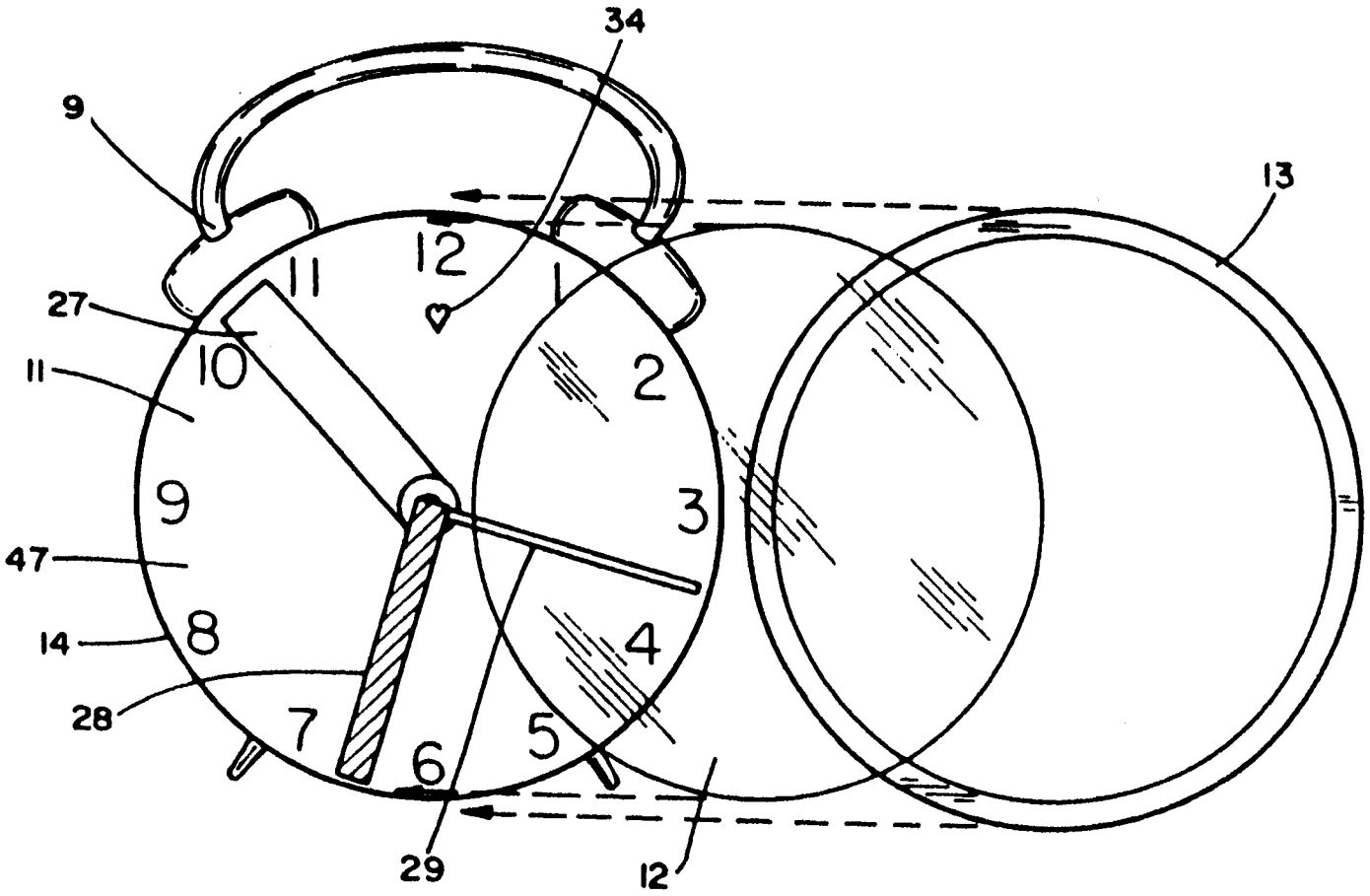
FIG. 12 shows an alarm clock having an interchangeable decorative member held in place by a support.

FIG. 12 illustrates an alarm clock 9 which includes a dial 47 having numbers for designating the time formed thereon. A decorative member 12 is locked by the support 13 in the same manner as described hereinabove.

Figure 13:
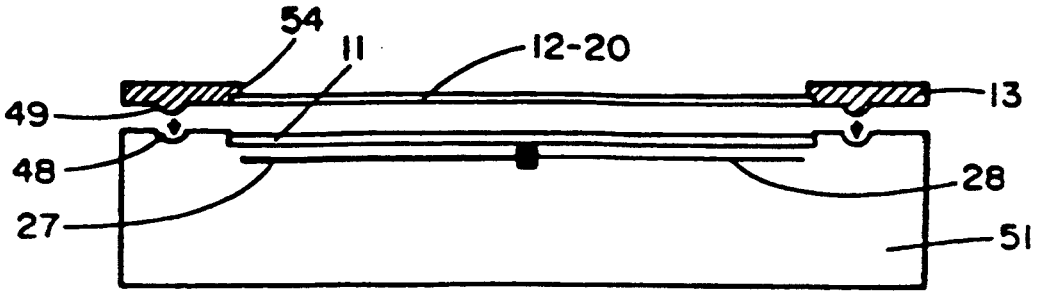
FIG. 13 illustrates a clock having an interchangeable decorative member mounted thereon and held in place by protrusions located on a support fitting in recesses formed in a clock frame.

FIG. 13 is a partial view of a frame 51 suitable for a clock 9 having hands 27 and 28 which designate the hours and the minutes and which have the same length. Hands 27 and 28 are covered by fixed glass member 11. Also shown is an interchangeable decorative member 12 applied on top of the transparent support 33*b* or on top of frame 33*a*. Decorative member 12 is inserted with pressure in the seat 54 of the support 13. Support 13 has a protrusion 49 which is inserted in a recess 43 formed in frame 51 of clock 9.

Figure 14:
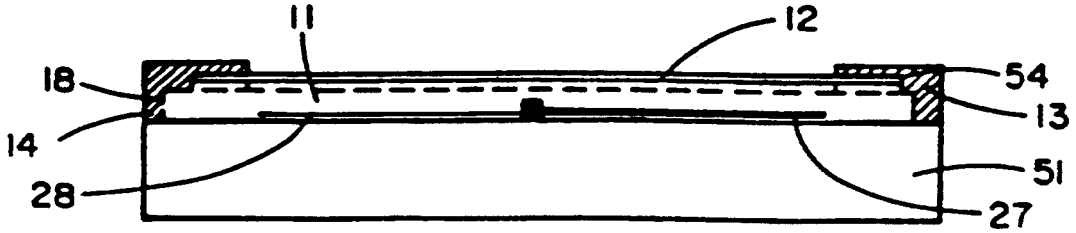
FIG. 14 shows a clock having an interchangeable decorative member held in place by being inserted into a seat provided in a support.

FIG. 14 is a cross-section of the frame 51 shown in FIG. 13. Frame 51 is suitable for a clock 9 such as an alarm clock, a clock to be mounted on a wall or mounted in a knapsack. Interchangeable decorative member 12 is inserted with pressure in a seat 54 formed in support 13. FIG. 14 also shows opening 14 of the frame being formed with a step structure 18 which receives the support 13 with pressure. Support 13 can be used alone or support 13 can be used together with frame 33*a* or support 33*b*, with the sides of frame 33*a* or support 33*b* being inserted in a compartment 54.

Figure 15:
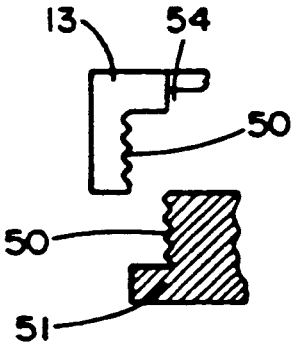
FIG. 15 shows a cross-section of a support which can be inserted on a clock frame to hold an interchangeable decorative member thereon.

FIG. 15 is a cross-section of support 13 which is inserted on frame 51 by a screw with threads 50 formed on both sides thereof. A seat 54 is provided in support 13 which receives an interchangeable decorative member 12.

Figure 16:
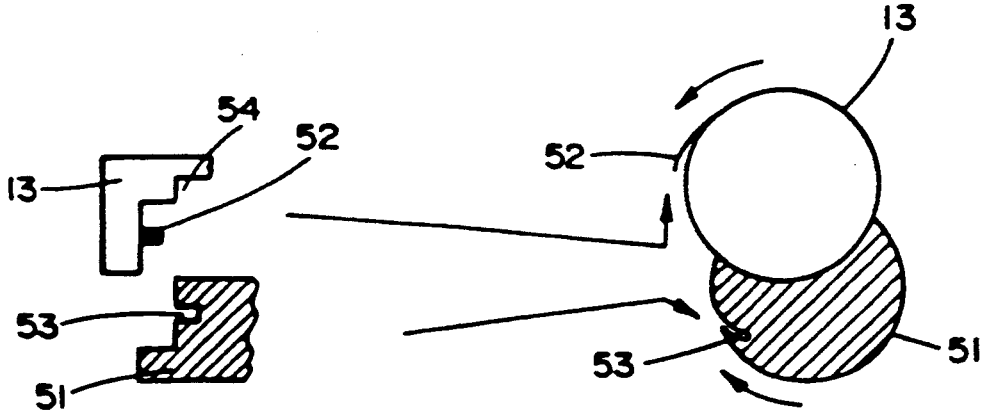
FIG. 16 shows a cross-section of an alternate embodiment of the support and frame shown in FIG. 15.

FIG. 16 is a cross-section of support 13 which is inserted into frame 51 by means of a bayonet structure. Numeral 52 designates a curved pin located in the interior part of support 13 or a small tooth which is inserted into a seat 53 by a slight rotation of support 13. Seat 54 receives interchangeable decorative member 12.

What is claimed is:

1. A clock comprising:

a frame having an opening;

a fixed glass member located on said frame;

a plurality of hands disposed under said fixed glass member;

an interchangeable decorative member;

an annular transparent support member mounted on said fixed glass member for supporting said decorative member; and a ring member located on said annular transparent support member and mounted on said opening of said frame for holding said annular transparent support member and interchangeable decorative member on said clock;.

said ring member having a first securing means for removably securing the ring member to said frame and a second securing means for removably securing the ring member to the annular transparent support member; wherein said first and second securing means are formed so as to connect the annular transparent support member, interchangeable decorative member and ring member in a single integral unit, said single integral unit being removable from the frame as an integral unit.

2. The clock according to claim 1, wherein said first securing means includes a plurality of magnets fixedly attached to said ring member at positions facing said frame.

3. The clock according to claim 2, wherein said second securing means comprises a plurality of fan-shaped members located on a side of said ring member opposite to a location of said first securing means.

4. The clock according to claim 3, wherein said plurality of fan-shaped members are located on said ring member to adhere to and grip said annular transparent support member.

5. The clock according to claim 1 wherein said supporting means comprises a support (13) held on top of said opening (14), and a seat (39*b* is) is formed between said frame and said fixed glass (11), said frame (33) is transparent, said decorative member is opaque, said frame being wider than said decorative member.

6. The clock according to claim 1 wherein said supporting means includes magnets and said magnets are inserted in the internal part of said opening (14).

7. The clock according to claim 1 wherein said supporting means comprises a transparent support (33*b* is) and said fixed glass (11) and said opening (14) form a compartment (39*b* is), said decorative member is disposed above said transparent support and said frame has grooves (38).

8. The clock according to claim 1 wherein said supporting means (13) has an outer border, it is made of plastic material, and has on said outer border a plurality of openings.

9. The clock according to claim 1 wherein a seat (39*b* is) is formed between said opening (14) in the frame and said fixed glass (11), said frame (33) has an outer border, has numbers (24*b* is) to indicate the time on said border thereof, said interchangeable decorative member has a pin (44) in the center thereof and two second hands (42,43) indicate the days and a third hand (41) indicates the month, said second and third hands rotating around said pin, and said interchangeable decorative member functions as a calendar.

10. The clock according to claim 1 wherein a film having numbers (24*b* is) designating the time impressed thereon adheres to the surface of said fixed glass (11).

11. The clock according to claim 1 wherein said supporting means comprise a transparent support (33*b* is), a seat is formed between said opening (14) in the frame and said glass, an ornamental design is impressed on said decorative member, said ornamental design (30,46) and said support (33*b* is) being inserted in said seat.

12. The clock according to claim 1 wherein said supporting means (13) has a protrusion (49) at each side thereof, said frame (51) has recesses (48), said protrusions engaging with said recesses (48) in said frame (51).

13. The clock according to claim 1 wherein said supporting means is a support, said support (13) forms a seat (54), said opening (14) of the frame (51) has a step structure (18), adapted to receive said support (13) with pressure.

14. The clock according to claim 1 which is an alarm clock.

15. The clock according to claim 1 which is a wall clock.

16. A watch in combination with a knapsack, said watch comprising:

a frame having an opening;

a fixed glass member located on the frame;

a plurality of hands disposed under said fixed glass member;

an interchangeable decorative member;

an annular support member mounted on said fixed glass member for supporting said decorative member; and a ring member located on said annular transparent support member and mounted on said opening of said frame for holding said annular transparent support member and interchangeable decorative member on said watch;

said ring member having a first securing means for removably securing the ring member to said frame and a second securing means for removably securing the ring member to the annular transparent support member; wherein said first and second securing means are formed so as to connect the annular transparent support member, interchangeable decorative member and ring member in a single integral unit, said single integral unit being removable from the frame as an integral unit.

17. The watch according to claim 16, wherein said first securing means includes a plurality of magnets fixedly attached on said ring member at positions facing said frame.

18. The watch according to claim 16, wherein said second securing means includes a plurality of fan-shaped members located on a side of said ring member opposite to a location of said first securing means.

19. The watch according to claim 18, wherein said plurality of fan-shaped members are located on said ring member to adhere to and grip said annular transparent support member.

20. The watch according to claim 16 wherein said supporting means comprises a support (13) held on top of said opening (14), and a seat (39*b* is) is formed between said frame and said fixed glass (11), said frame (33) is transparent, said decorative member is opaque, said frame being wider than said decorative member.

21. The watch according to claim 16 wherein said supporting means includes magnets and said magnets are inserted in the internal part of said opening (14).

22. The watch according to claim 16 wherein said supporting means comprises a transparent support (33*b* is) and said fixed glass (11) and said opening (14) form a compartment (39*b* is), said decorative member is disposed above said transparent support and said frame has grooves (38).

23. The watch according to claim 16 wherein said supporting means (13) has an outer border, it is made of plastic material, and has on said outer border a plurality of openings.

24. The watch according to claim 16 wherein a seat (39*b* is) is formed between said opening (14) in the frame and said fixed glass (11), said frame (33) has an outer border, has numbers (24*b* is) to indicate the time on said border thereof, said interchangeable decorative member has a pin (44) in the center thereof and two second hands (42,43) indicate the days and a third hand (41) indicates the month, said second and third hands rotating around said pin, and said interchangeable decorative member functions as a calendar.

25. The watch according to claim 16 wherein a film having numbers (24*b* is) designating the time impressed thereon adheres to the surface of said fixed glass (11).

26. The watch according to claim 16 wherein said supporting means comprise a transparent support (33*b* is), a seat is formed between said opening (14) in the frame and said glass, said ornamental design (30,46) and said support (33*b* is) being inserted in said seat.

27. The watch according to claim 16 wherein said supporting means is a support, said support (13) has a protrusion (49) at each side thereof, said frame (51) has recesses (48), said protrusions engaging with said recesses (48) in said frame (51).

28. The watch according to claim 16 wherein said support (13) forms a seat (54), said opening (14) of the frame (51) has a step structure (18), adapted to receive said support (13) with pressure.

* * * * *